US008213627B2

(12) United States Patent
Joeng et al.

(10) Patent No.: US 8,213,627 B2
(45) Date of Patent: Jul. 3, 2012

(54) METHOD AND APPARATUS FOR MONITORING A HEARING AID

(75) Inventors: Lilyana Joeng, Singapore (SG); Wee Haw Koo, Singapore (SG); Meng Kiang Lim, Singapore (SG); Poh Chye Lim, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 732 days.

(21) Appl. No.: 12/371,150

(22) Filed: Feb. 13, 2009

(65) Prior Publication Data

US 2009/0202084 A1 Aug. 13, 2009

(30) Foreign Application Priority Data

Feb. 13, 2008 (DE) ..... 10 2008 008 898

(51) Int. Cl.
*H04R 29/00* (2006.01)
*H04R 25/00* (2006.01)

(52) U.S. Cl. ..... 381/60; 381/312; 381/316

(58) Field of Classification Search ..... 381/60, 381/312, 315

See application file for complete search history.

(56) References Cited

U.S. PATENT DOCUMENTS

| | | | | |
|---|---|---|---|---|
| 4,378,466 | A | 3/1983 | Esser | |
| 4,650,927 | A | 3/1987 | James | |
| 7,439,456 | B2 | 10/2008 | Ogunnaike | |
| 2002/0176588 | A1 | 11/2002 | Seto et al. | |
| 2007/0269065 | A1* | 11/2007 | Kilsgaard | 381/315 |
| 2008/0101635 | A1* | 5/2008 | Dijkstra et al. | 381/315 |

FOREIGN PATENT DOCUMENTS

| | | | |
|---|---|---|---|
| DE | 19740616 | A1 | 3/1999 |
| DE | 101 10 945 | A1 | 5/2002 |
| DE | 102008001948 | A1 | 1/2009 |
| EP | 0 009 714 | A2 | 4/1980 |
| EP | 0 184 005 | A2 | 6/1986 |
| EP | 1 353 529 | A1 | 10/2003 |
| FR | 2 624 005 | A1 | 6/1989 |
| GB | 2 414 655 | A | 12/2005 |
| JP | 10-302184 | A | 11/1998 |
| JP | 11-276517 | A | 10/1999 |
| JP | 2002-367010 | A | 12/2002 |
| KR | 10-2006-0098603 | A | 9/2006 |
| WO | 2006/074655 | A1 | 7/2006 |

OTHER PUBLICATIONS

German Search Report dated Jun. 2, 2009.

* cited by examiner

*Primary Examiner* — Benjamin Sandvik
*Assistant Examiner* — Whitney T Moore
(74) *Attorney, Agent, or Firm* — Laurence A. Greenberg; Werner H. Stemer; Ralph E. Locher

(57) ABSTRACT

A hearing aid contains a microphone detecting an acoustic input signal and converts it to an electrical output signal, a receiver producing an acoustic output signal being dependent on an electrical output signal of the microphone, and a transmitter transmitting a monitoring signal, which is dependent on the electrical output signal. A transceiver contains a receiver for receiving the monitoring signal, and a signal processing device for processing the monitoring signal. The signal processing device processes the monitoring signal to produce an indication signal which is acoustically restricted with respect to the monitoring signal such that it simulates a restricted hearing capability of a person, or which indicates an operating/signal state of the hearing aid. The transmission of the monitoring signal to the transceiver and the processing to form the indication signal provides information about the state of the hearing aid for monitoring of the hearing aid.

21 Claims, 2 Drawing Sheets

METHOD AND APPARATUS FOR MONITORING A HEARING AID

CROSS-REFERENCE TO RELATED APPLICATION

This application claims the priority, under 35 U.S.C. §119, of German application DE 10 2008 008 898.6, filed Feb. 13, 2008; the prior application is herewith incorporated by reference in its entirety.

BACKGROUND OF THE INVENTION

Field of the Invention

The invention relates to a system, to a portable transceiver and to a method for monitoring a hearing aid, and to a hearing aid which is suitable for this purpose.

For people in the vicinity of a hearing-aid wearer, there is often a problem that they often cannot know whether and what the hearing-aid wearer is perceiving or has perceived acoustically. It is often unclear at this stage whether a hearing-aid wearer has perceived anything at all. Children or older people in particular are frequently unable to indicate what they have heard. It is just as difficult for them to provide information as to whether they are perceiving their environment as quiet or loud, or full of interference noise. It is frequently possible to detect whether a hearing-aid wearer has perceived something acoustically only by gestures or the facial expression of the hearing-aid wearer.

The effects on the hearing perception which are caused by an individual hearing loss or a suitable hearing aid supply can be made audible by simulation both to those with normal hearing and to those affected by a hearing disability. Multichannel dynamic expansion systems make it possible to simulate the hearing impression which is produced by an individual hearing loss or by a hearing aid supply, by use of channel-dependent amplification in a plurality of channels, with an additional dependency on the respective input level. This simulation process is also referred to as auralization. By way of example, auralization provides a person with normal healthy hearing with an acoustic impression of the hearing perception of a person with individual hearing loss.

The parameters which are specific for an individual hearing loss or for a specific hearing loss category for the dynamic expansion systems are determined by audiometric measurements. The hearing losses which occur are highly varied and cover very different characteristics. Examples of these aspects are reduced time resolution and frequency resolution or so-called recruitment, which describes the change in the volume perception of those with hearing disabilities.

In the case of hearing losses, it is useful from many points of view to offer the person in the vicinity of a person with a hearing disability auralization of the effect of the hearing disability. For example, for this purpose, simulation can be used to give an impression to the relatives with normal hearing of the hearing impression of the person with a hearing disability with and without assistance by the respective hearing aid. A person with normal hearing can use this to test or simulate the effect of hearing-aid assistance for a hearing-aid wearer, at least to a limited extent.

One precondition for auralization is an audiometric measurement and creation of an individual audiogram. Measurements such as these can be carried out only by specialists, for example hearing-aid device audiologists and doctors. The corresponding systems can, furthermore, be used only by experts and are also financially worthwhile only for them.

In order to simulate the hearing capability of a person, in particular of a person with a hearing disability, it is known from German patent DE 101 10 945 for the hearing capability of this person to be recorded first of all. To do this, the hearing capability is tested in a plurality of realistic environmental situations. These situations are preferably simulated in a room which is configured to be suitable for this purpose, the so-called measurement room. Characteristic variables of the audiogram are derived from the tests, characterizing the hearing capability of the relevant person as comprehensively as possible. In order to provide third parties, for example relatives of the person, with an impression of the hearing capability of the relevant person, test signals are then produced in which the noises in realistic situations are modified corresponding to the recording audiogram such that this gives a person with normal hearing the same hearing impression which the (unmodified) noise would cause in a person with a hearing disability.

However, the measurements are carried out exclusively in laboratory conditions, so that individual noise environments that actually occur and occur in the respective environment of the person with the hearing disability can be considered only inadequately.

European patent EP 1 353 529 discloses a simulation apparatus in which simulation data for a plurality of typical hearing loss categories and for a plurality of hearing aid models can be transferred from one user to another via a data network. This allows both the recording of audiometric data with the user and the auralization of the effects associated with this on the hearing perception as well as the selection of a suitable hearing aid and its matching and demonstration for the person affected to be offered via the Internet. The affected person can thus carry out tests relating to his hearing capability in the home environment, but with a quality which is restricted by the hardware available to him.

However, the measurements are possible exclusively with access to a computer and a data network. Furthermore, the measurement results must in each case be transmitted to a computer system and must be evaluated there before they can be used for auralization. Conclusions relating to the hearing impression in real-time conditions and in any given life situations, for example outside the range of the computer, are thus not possible.

A further difficulty is that hearing aids may have different hearing programs for different noise environments. Switching can be carried out between the different hearing programs either automatically by the hearing aid or manually by the hearing-aid wearer. The various possible hearing programs result in an additional multiplicity of variation options. These would have to be taken into account for auralization if a respectively currently appropriate hearing impression of the respective environmental situation is intended to be given taking into account the operation of the hearing aid.

The number of variations to be simulated is additionally enormously increased if adaptive filters and amplifiers are used in the hearing aid. Realistic simulation, matching all the stated conditions, in real time is therefore very difficult with the known apparatuses and methods.

International patent disclosure WO 2006/074655 A1, corresponding to U.S. patent publication No. 20070269065, discloses a hearing-aid system containing a hearing aid and a portable module for monitoring the hearing aid. The portable module can receive data from the hearing aid representing the signal processing parameters of the hearing aid in real time. This allows remote monitoring of the hearing aid.

Despite the known options for monitoring by auralization, monitoring of the effect of hearing-aid assistance on a hearing-aid wearer in real time and at any desired locations has therefore not been possible until now.

SUMMARY OF THE INVENTION

It is accordingly an object of the invention to provide a method and an apparatus for monitoring a hearing aid which overcome the above-mentioned disadvantages of the prior art methods and devices of this general type, which allows monitoring of the effect of hearing-aid assistance on a hearing-aid wearer in real time and at any desired location.

With the foregoing and other objects in view there is provided, in accordance with the invention a hearing aid system. The system includes a hearing aid having a microphone for detecting an acoustic input signal and converting the acoustic input signal into an electrical output signal, a receiver for producing an acoustic output signal being dependent on the electrical output signal of the microphone, and a transmitter for transmitting a monitoring signal, which is dependent on the electrical output signal of the microphone. The system further includes a portable transceiver having a receiver for receiving the monitoring signal, and a signal processing device for processing the monitoring signal received and is coupled to the receiver. The signal processing device produces an indication signal in dependence on the monitoring signal received.

One fundamental idea of the invention is to provide a system for monitoring a hearing aid containing the hearing aid and a portable transceiver. The hearing aid contains a transmitter which transmits a monitoring signal, which is dependent on an electrical output signal of the microphone of the hearing aid. The portable transceiver contains a receiver for reception of the monitoring signal as well as a signal processing device for processing of a received monitoring signal, with the signal processing device using the received monitoring signal to produce an indication signal which allows monitoring of the hearing assistance by the hearing aid.

Further fundamental ideas of the invention contain a specification of a correspondingly configured hearing aid, a correspondingly configured transceiver and a corresponding method.

The indication signal makes it possible to monitor a signal state or an operating state of the hearing aid. An important feature of this is that the indication signal is dependent on a monitoring signal which is normally available only in the interior of the hearing aid. The monitoring signal is characteristic of the assistance effect of the hearing aid, which normally has an effect which can be perceived only by the hearing-aid wearer. For example, it can indicate an operating state of the hearing aid, such as the currently active hearing program, or a signal state within the hearing aid, such as a filter or gain setting, or it can reflect the audio signal produced by the hearing aid. If the monitoring signal reflects the audio signal produced by the hearing aid, then this will have already passed through the signal processing by the hearing aid. The change in the audio signal by the hearing aid therefore need no longer be simulated externally, and, instead, the modified audio signal is available directly.

The transmission of the monitoring signal to the transceiver and the processing to form the indication signal results in information being available externally as well about the state of the hearing aid, in order to monitor the hearing aid. The indication signal can therefore be used to monitor the operation of the hearing aid and the effect of the hearing assistance without this requiring any reaction or response from the hearing-aid wearer. Since the transceiver is in the form of a portable appliance, monitoring such as this can be carried out at any desired locations. Since, furthermore, the transceiver is not dependent on data network access to a database or a computer, but itself carries out the processing of the monitoring signal directly, this results in only negligibly short time delays.

In one advantageous refinement of the invention, the production of the indication signal by the signal processing device includes a restriction of the received monitoring signal, such that the restriction simulates the restriction of the hearing capability of a person with hearing loss. If an electrical signal which corresponds essentially to the acoustic signal recorded by the microphone of the hearing aid, after amplification by the hearing aid and shortly before transmission to the receiver, is now used as the monitoring signal, then the hearing impression or the hearing perception as produced in the case of the hearing-aid wearer can be simulated by the indication signal. This allows the hearing perception of the hearing-aid wearer to be auralized for people with normal hearing, by the transceiver.

The auralization with the aid of the transceiver allows people in the vicinity of the hearing-aid wearer to monitor at any time whether the hearing-aid wearer is receiving acoustic signals which have been amplified in a usable form by the hearing aid and allow hearing or understanding. All that is necessary to do this is to output the indication signal by a loudspeaker or headset, as an acoustic signal. Furthermore, people in the vicinity can also monitor at any time whether the acoustic signal amplified by the hearing aid is being adversely affected or distorted by excessive noise or other interference factors.

In a further advantageous refinement of the invention, the monitoring signal is obtained at a signal input of the receiver of the hearing aid. The signal that has been amplified by the hearing aid and is emitted through the receiver of the hearing aid to the hearing-aid wearer is thus actually the one available to the transceiver after reception of the monitoring signal. This signal, as a monitoring signal, represents a particularly worthwhile basis for signal processing, in particular the auralization, by the transceiver.

In a further advantageous refinement of the invention, the production of the indication signal by the signal processing device includes the determination of a gain which is a function of an audio frequency of the received monitoring signal. This allows the frequency-dependent gain of the hearing aid to be recorded or made available in the transceiver. The gain spectrum can vary in particular in the case of hearing aids with adaptive gain or adaptive filters, and as a result of hearing program switching operations as well. The determination of this spectrum by the transceiver allows comparison with a predetermined nominal value at any time, for example with an audiogram of the hearing-aid wearer in the course of so-called "audiogram matching".

In a further advantageous refinement of the invention, the production of the indication signal by the signal processing device includes the determination of an interference noise level of the received monitoring signal. In the case of hearing aids, operating states also occur in which noise or background noise is amplified more than proportionally. In consequence, it is possible for hearing perception of the hearing-aid wearer to be greatly distorted or interfered with, while a person with normal hearing would not perceive any increased amount of interference noise. Since, by use of the indication signal, the transceiver provides a person with normal hearing with information relating to the interference noise level occurring in the hearing aid, it allows this person to carry out a comparison of the actual hearing impression in the respective situation. The person with normal hearing can in this way monitor the operation of the hearing aid. This person can on the one hand ask the hearing-aid wearer to make a hearing program change, and on the other hand this person can take account of the restricted or disturbed hearing perception of the hearing-aid wearer.

In a further advantageous refinement of the invention, the transceiver has a data memory for recording the monitoring signal. The recordings can be used to analyze the operation of the hearing aid or the state of the current hearing perception capability of the hearing-aid wearer subsequently, for example by a doctor or a hearing-aid audiologist.

In a further advantageous refinement of the invention, the recording is started by a user. The hearing-aid wearer or a person in the vicinity can thus start the recording in particular in problem situations, in which the hearing aid provides only defective or restricted hearing assistance. Problem situations such as these can be analyzed retrospectively with the aid of the recording.

In a further advantageous refinement of the invention, the recording is carried out as a function of the received monitoring signal. For example, the hearing aid can use the monitoring signal to transmit the signal for starting the recording, in order in this way to have the capability to initiate the recording itself. This allows a recording to be made as a function of an internal state or operating state of the hearing aid.

In a further advantageous refinement of the invention, the recording is started as a function of a hearing program change which is signaled by the monitoring signal. This allows situations to be analyzed retrospectively which are related to a hearing program change or could be the reason for this.

Other features which are considered as characteristic for the invention are set forth in the appended claims.

Although the invention is illustrated and described herein as embodied in a method and an apparatus for monitoring a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
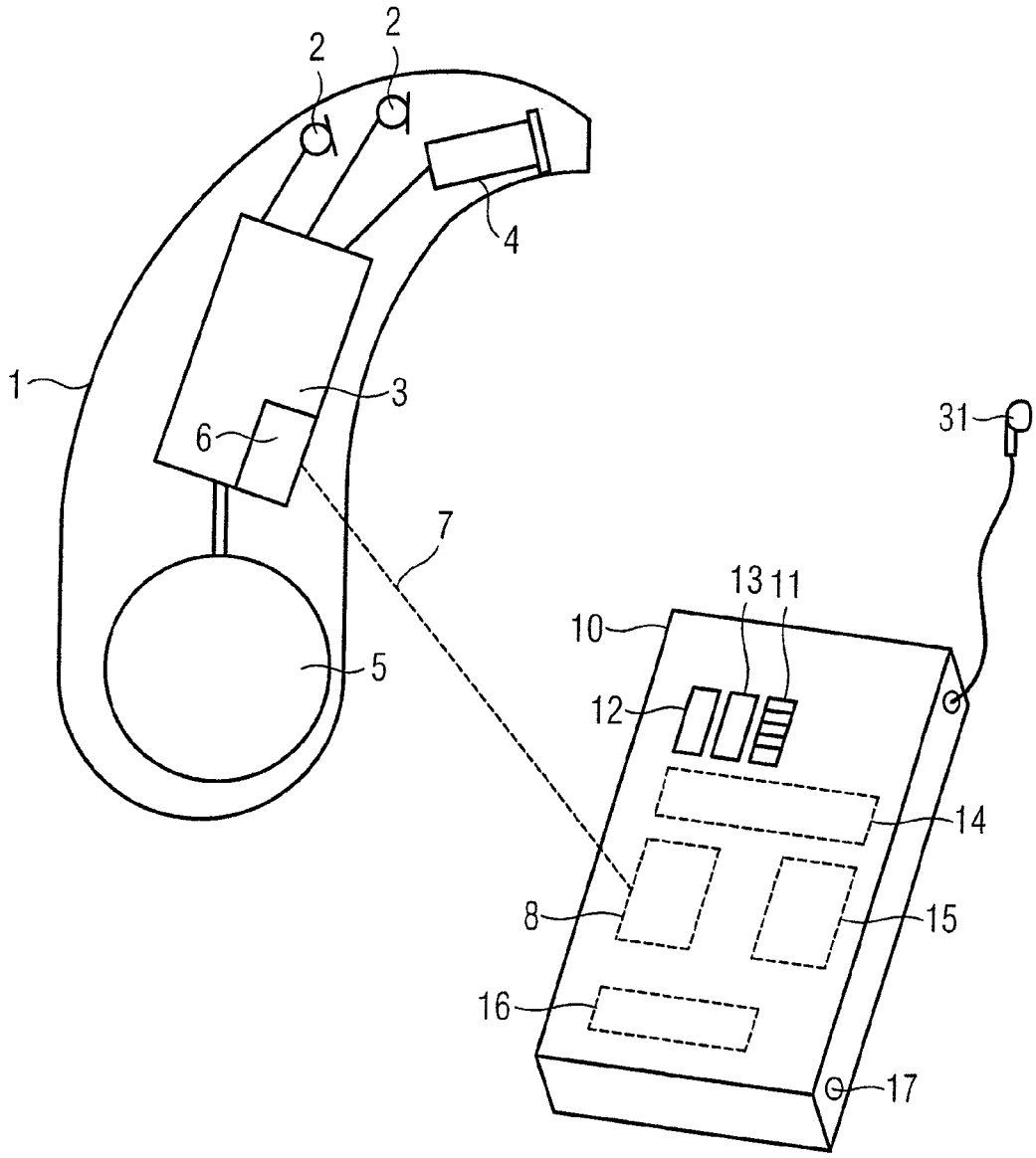
FIG. 1 is an illustration of a hearing aid and a transceiver with a headset according to the invention.

Referring now to the figures of the drawing in detail and first, particularly, to FIG. 1 thereof, there is shown schematically a hearing aid with a portable transceiver. In principle, the major components of hearing aids are an input transducer, an amplifier and an output transducer. The input transducer is generally a sound receiver, for example a microphone, and/or an electromagnetic receiver, for example an induction coil. The output transducer is generally in the form of an electroacoustic transducer, for example a miniature loudspeaker, or an electromechanical transducer, for example a bone conduction transducer, and is generally referred to as a receiver. The amplifier is normally integrated in a control unit.

This basic configuration is illustrated in FIG. 1 using the example of a behind-the-ear hearing aid. One or more microphones 2 for receiving sound from the environment are installed in a hearing-aid housing 1 to be worn behind the ear. A control unit 3, which is likewise integrated in the hearing-aid housing 1, processes and amplifies the microphone signals. The output signal from the control unit 3 is transmitted to a receiver 4, which emits an acoustic signal. The sound is, possibly, transmitted via a flexible sound tube, which is fixed in the auditory channel by an otoplastic, to the tympanic membrane of the hearing-aid wearer. The electrical power supply for the hearing aid and in particular that for the control unit 3 is provided by a battery 5, which is likewise integrated in the hearing-aid housing 1.

A transmitter 6 is likewise integrated in the hearing-aid housing 1. The transmitter 6 is used to transmit a monitoring signal from the hearing-aid housing 1 to the exterior. The monitoring signal is made available by the control unit 3. The transmitter 6 and the transmission process are also activated by the control unit 3. For example, the transmitter 6 can operate on the basis of an RF radio link; when using an RF radio link, there is advantageously no need for a visual link between the transmitter and the receiver. However, the transmitter 6 can also operate on the basis of a different link, for example an IR link.

The hearing aid is connected via a radio link 7 to a portable transceiver 10. The hearing aid can transmit the monitoring signal to the transceiver 10 via the radio link 7. The transceiver 10 has a receiver 8 for reception of the monitoring signal that is transmitted by the hearing aid. A signal processing device 14 is provided in the transceiver 10 and processes the monitoring signal received via the radio link 7.

Furthermore, the transceiver 10 has an on/off switch 12, by which the transceiver 10 can be switched on or switched off. A key 13 is used to start a recording of the monitoring signal received from the hearing aid. A data memory 15, which is integrated in the transceiver 10, is provided for recording. The data memory 15 may, for example, be in the form of a solid-state memory; solid-state memories operate in a manner which is not sensitive to vibration and with low energy consumption. The data memory 15 may, however, also be in the form of a hard-disk memory or tape memory.

A headset 31 is connected to the transceiver 10 via an appropriate output. The headset 31 is used to make audio monitoring signals received from the hearing aid audible for a user. The volume of the headset signal can be adjusted by a volume control 11.

The transceiver 10 has a battery 16 as a voltage supply. The battery 16 may, for example, be in the form of a rechargeable battery. Instead of this, however, it is also possible to use non-rechargeable batteries. Alternatively, a supply connection 17 is provided for connection of the transceiver 10 to a voltage supply, for example mains power. When using rechargeable batteries, charging current can also be supplied via the supply connection 17.

The monitoring signal transmitted from the hearing aid is used to monitor an operating state or signal state of the hearing aid, with the aid of the transceiver 10. The hearing aid produces an output signal which is amplified by various filter and amplification stages and emits this via the receiver 4 to the hearing-aid wearer. The gain characteristics of the hearing aid are in this case normally matched to the individual hearing loss of the hearing-aid wearer. This also results in the audio signal being distorted by the hearing aid. However, the audio signal should be distorted in such a way that the distortion is compensated for again by the restriction of the audio signal by the individual hearing loss of the hearing-aid wearer. Thus, ideally, the hearing aid should produce an audio signal which provides the hearing-aid wearer with a hearing impression that is as natural as possible.

In one exemplary embodiment, the audio signal as modified by the hearing aid can be transmitted as a monitoring signal to the transceiver 10. Information about the individual hearing loss of the hearing-aid wearer, which has been determined in the form of so-called audiogram, is stored in the transceiver 10. The signal processing device 14 which is integrated in the transceiver 10 uses this audiogram information to change the input-side audio signal, received as a monitoring signal, to an output-side audio signal. The signal processing device 14 in this case restricts the audio signal such that the restriction simulates the restriction resulting from the hearing loss of the hearing-aid wearer. The original audio signal therefore first of all passes through the processing by the hearing aid and, after transmission as a monitoring signal, the restricting processing by the signal processing device 14. Overall, this thus results in production of an audio signal which reflects the hearing impression of the hearing-aid wearer for people with normal hearing.

Acoustic reproduction of this signal therefore makes it possible to simulate for a person with normal hearing the hearing impression which the hearing-aid wearer receives, and this is referred to as auralization. If this auralization is carried out using the monitoring signal, then the auralized monitoring signal actually represents the audio signal which the hearing aid emits to the hearing-aid wearer. Any hearing program changes, filter settings or the like of the hearing aid do not need to be separately taken into account in the simulation since the monitoring signal which is transmitted from the hearing aid has in fact passed through all such signal processing steps.

When the hearing aid is set correctly, this should therefore result in a largely natural and normal audio signal. A person with normal hearing can thus monitor, by listening to the auralized monitoring signal, whether the hearing-aid wearer is receiving a usable acoustic signal which allows normal hearing and understanding.

Figure 2:
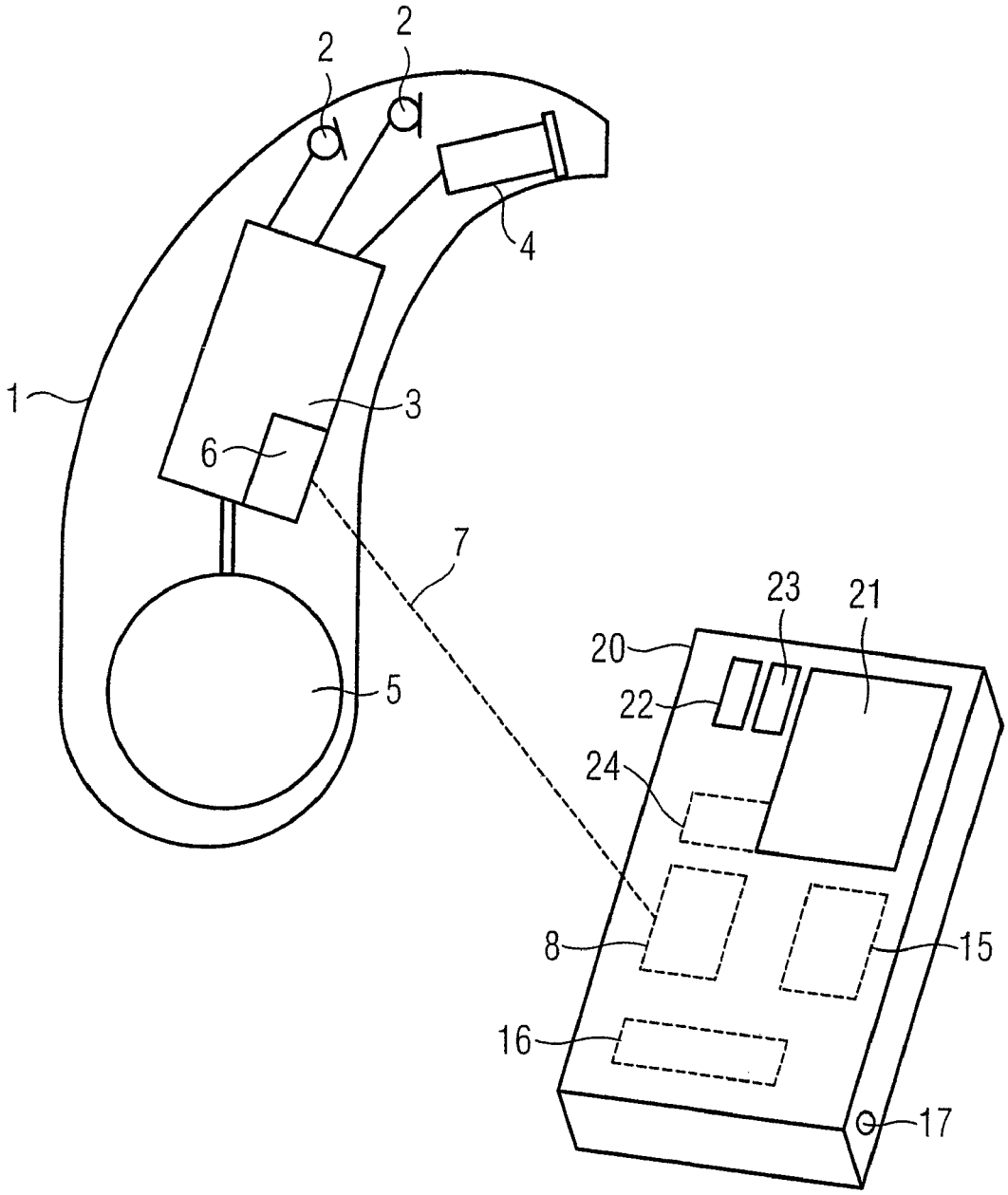
FIG. 2 is an illustration of the hearing aid and the transceiver with a screen.

FIG. 2 schematically illustrates the same hearing aid as that shown in FIG. 1, using the same reference symbols. A portable transceiver 20, which has been slightly modified from that shown in FIG. 1, is represented via the radio link 7 for the monitoring signal. To the extent that the same reference symbols are used, the portable receiver 20 likewise has a receiver 8 and a battery 16, a supply connection for a voltage supply 17, and a data memory 15.

Furthermore, the transceiver 20 has an on/off switch 22 as well as a key 23 for manually starting a recording of the monitoring signal by the data memory 15.

In contrast to the previous illustration, the transceiver 20 does not have an audio output for connection of a head set. Instead of this it has a display 21.

In one embodiment of the transceiver 20, the integrated signal processing device 24 analyzes the monitoring signal received from the hearing aid by determining a noise level in the monitoring signal. The noise level is determined as a single component of the audio signal as amplified in the hearing aid and represents a base noise level in the amplified acoustic signal emitted to the hearing-aid wearer. The transceiver 20 numerically or graphically visualizes a measure for this noise level on the display 21; by way of example, the display may be in the form of a number or a line on a diagram illustration of the acoustic signal spectrum.

In a further embodiment, the signal processing device 24 uses the monitoring signal to determine a frequency-dependent gain spectrum of the hearing aid. The frequency-dependent gain spectrum can be displayed numerically or graphically on the display 21. Additionally or alternatively, it can be analyzed in a comparative form with audiogram data stored in the transceiver 20 for the hearing-aid wearer. A result of the comparative analysis can be displayed numerically or graphically on the display 21. So-called "audiogram matching" can be carried out in this way.

The variants of the portable transceiver as explained above allow the monitoring of a hearing aid in real time and independently of position in a respective environment in that a person with normal hearing in the vicinity of the hearing-aid wearer receives information about the present signal state or operating state in the hearing aid or an impression of the acoustic signal that is currently being emitted to the hearing-aid wearer, visually or acoustically, by the transceiver 20. The person with normal hearing can compare the environment characteristic or information, as indicated by the transceiver 20, with the hearing impression actually perceived by him. This makes it possible, for example, for the person with normal hearing to tell whether the hearing aid is producing a noise signal which is unnaturally increased in comparison to the actual environmental situation.

In addition, when the auralized audio signal that has been amplified by the hearing aid is reproduced acoustically, it is also possible for the person with normal hearing to tell whether the hearing-aid wearer is receiving an acoustic signal which allows identification of specific features, for example speech, at all. If the hearing aid is providing the hearing-aid wearer with a highly distorted or very adversely affected acoustic signal which makes it difficult to identify speech, the person with normal hearing will also receive an acoustic signal of the same type via the auralization; he will thus be able to also monitor subjective features, such as the comprehensibility of speech.

If a person with normal hearing comes to the conclusion on the basis of the monitoring by the transceiver that the hearing aid is producing a highly distorted or restricted signal, he can initiate switching of the hearing program. For this purpose, for example, he can instruct the hearing-aid wearer to carry out the necessary switching. However, it is also feasible for the person with normal hearing himself to carry out the switching of the hearing program for the hearing-aid wearer, for example with the aid of a transceiver programming function which can be provided for this purpose.

Furthermore, the recording function of the transceiver can be used to start a recording of the monitoring signal whenever problems are found in the monitoring of the operating of the hearing aid, for example severe noise or restricted speech comprehensibility. For this purpose, a recording can be started manually by the person with normal hearing.

However, the recording can also be started by the hearing-aid wearer himself, for example whenever he finds a perception problem in a situation. There is no need for additional monitoring by a person with normal hearing located in the vicinity, for this purpose.

In further embodiment variants, the recording can be started automatically as well. For example, the transceiver can start the recording if it finds an increased noise component in the audio signal. The recording can also be started if a predetermined frequency of hearing program changes in the hearing aid is overshot or undershot. For this purpose, the signal processing device in the transceiver would have to monitor the frequency of hearing program changes, in which case the hearing program changes would either be determined by analysis of the monitoring signal or would be signaled by an appropriate element within the monitoring signal.

In the exemplary embodiment described above, the monitoring signal may correspond to the audio signal as amplified by the hearing aid. This audio signal is tapped off after the processing within the hearing aid. The audio signal is advantageously transmitted by the transmitter 6, tapped off before the amplification for the receiver 4.

In a further embodiment variant, the monitoring signal contains—in addition to the audio signal or exclusively—information about the operating state of the hearing aid, for example about the hearing program or filter settings. When appropriate information is indicated, monitoring can be carried out, for example, by the transceiver, or the hearing aid operates using a hearing program which is matched to the respective noise environment.

In summary, the basic idea of the invention can be described as follows: the invention relates to a system, to a transceiver and to a method for monitoring a hearing aid, and to a hearing aid which is suitable for this purpose. The hearing aid in this case contains a microphone which detects an acoustic input signal and converts it to an electrical output signal, a receiver which produces an acoustic output signal which is a function of an electrical output signal of the microphone, and a transmitter which transmits a monitoring signal, which is dependent on an electrical output signal of the microphone. The portable transceiver contains a receiver for reception of the monitoring signal and a signal processing device for processing the received monitoring signal. The signal processing device processes the received monitoring signal to produce an indication signal which is acoustically restricted with respect to the monitoring signal such that the restriction simulates the restriction of hearing capability of a person with hearing loss. As a result, the transceiver can simulate for a person with normal hearing that hearing impression which the hearing-aid wearer respectively receives. The signal processing device can also indicate an operating state or a signal state of the hearing aid. The transmission of the monitoring signal to the transceiver and the processing to form the indication signal provides information about the state of the hearing aid for monitoring of the hearing aid, even from outside the hearing aid.

The invention claimed is:

1. A hearing aid system, the system comprising:

a hearing aid, including:

a microphone for detecting an acoustic input signal and converting the acoustic input signal into an electrical output signal;

a receiver producing an acoustic output signal being dependent on the electrical output signal of said microphone; and a transmitter for transmitting a monitoring signal, which is dependent on the electrical output signal of said microphone;

a portable transceiver, including:

a receiver for receiving the monitoring signal; and a signal processing device for processing the monitoring signal received and coupled to said receiver, said signal processing device configured to acoustically restrict said received monitoring signal producing an indication signal that simulates a restriction of a hearing capability of a person with hearing loss in dependence on the monitoring signal received.

2. The system according to claim 1, wherein the monitoring signal is obtained at a signal input of said receiver.

3. The system according to claim 1, wherein a production of the indication signal by said signal processing device includes determination of a gain which is dependent on an audio frequency of the monitoring signal.

4. The system according to claim 1, wherein the production of the indication signal by said signal processing device includes determination of an interference noise level of the monitoring signal received.

5. The system according to claim 1, wherein said transmitter transmits the monitoring signal on a wire-free basis.

6. The system according to claim 1, further comprising a headset and said portable transceiver is connected to said head set for conversion of the indication signal to an acoustic output signal.

7. The system according to claim 1, wherein said portable transceiver has a signal output for transmission of the indication signal to one of an acoustic indication apparatus and a visual indication apparatus.

8. The system according to claim 1, wherein said portable transceiver has a data memory for recording the monitoring signal.

9. A hearing aid and apparatus for monitoring the hearing aid, comprising:

a hearing aid, including:

a microphone for detecting an acoustic input signal and converting the acoustic input signal into an electrical output signal;

a receiver for producing an acoustic output signal which is dependent on the electrical output signal of said microphone; and a transmitter for transmitting a monitoring signal, which is dependent on the electrical output signal of said microphone;

a portable transceiver for monitoring the hearing aid, the portable transceiver, including:

a receiver for receiving a monitoring signal; and a signal processing device for processing the monitoring signal received, said signal processing device configured to acoustically restrict said received monitoring signal producing an indication signal that simulates a restriction of a hearing capability of a person with hearing loss in dependence on the monitoring signal received, the indication signal indicating one of a signal state of the hearing aid or an operating state of the hearing aid.

10. The portable transceiver according to claim 9, wherein a production of the indication signal by said signal processing device includes a determination of a gain which is dependent on an audio frequency of the monitoring signal.

11. The portable transceiver according to claim 9, wherein a production of the indication signal by said signal processing device includes a determination of an interference noise level of the monitoring signal received.

12. The portable transceiver according to claim 9, wherein the portable transceiver is connectable to a headset for producing an acoustic output signal from the indication signal.

13. The portable transceiver according to claim 9, further comprising a signal output for transmission of the indication signal to at least one of an acoustic apparatus and a visual indication apparatus.

14. The portable transceiver according to claim 9, further comprising a data memory for recording the monitoring signal.

15. A method for monitoring a hearing aid, which comprises the steps of:

transmitting, via the hearing aid, a monitoring signal;

receiving the monitoring signal via a transceiver;

processing the monitoring signal received in the transceiver; and producing an indication signal in dependence on the processing of the monitoring signal received, with the indication signal indicating one of a signal state of the hearing aid, an operating state of the hearing aid, and being acoustically restricted with respect to the monitoring signal such that a restriction simulates a restriction of a hearing capability of a person with hearing loss.

16. The method according to claim 15, which further comprises producing the indication signal by determining a gain which is dependent on an audio frequency of the monitoring signal.

17. The method according to claim 15, which further comprises producing the indication signal by determining an interference noise level of the monitoring signal received.

18. The method according to claim 15, which further comprises recording the received monitoring signal.

19. The method according to claim 18, which further comprises starting the recording of the received monitoring signal via a user.

20. The method according to claim 18, which further comprises starting the recording of the received monitoring signal in dependence on the received monitoring signal.

21. The method according to claim 18, which further comprises starting the recording of the monitoring signal in dependence on a hearing program change which is signaled by the monitoring signal.

* * * * *